US005964508A

United States Patent [19]

Maurer

[11] Patent Number: 5,964,508

[45] Date of Patent: Oct. 12, 1999

[54] METHOD FOR PRODUCING BRUSHES WITH FLEXIBLE BRISTLES AND BRUSHES WITH STIFF BRISTLES

[75] Inventor: Andreas Maurer, Zurich, Switzerland

[73] Assignee: Ingenieurburo A. Maurer & Partner, Zurich, Switzerland

[21] Appl. No.: 08/737,645

[22] PCT Filed: May 4, 1995

[86] PCT No.: PCT/CH95/00102

§ 371 Date: Feb. 7, 1997

§ 102(e) Date: Feb. 7, 1997

[87] PCT Pub. No.: WO95/31917

PCT Pub. Date: Nov. 30, 1995

[30] Foreign Application Priority Data

May 20, 1994 [CH] Switzerland ..... 1572/94

[51] Int. Cl.[6] ..... A46B 3/06

[52] U.S. Cl. ..... 300/21; 15/167.1; 15/193; 15/DIG. 5; 15/200

[58] Field of Search ..... 15/186–188, 190, 15/191.1, 192, 193, 200, 204, 201, DIG. 5, 167.1; 300/21

[56] References Cited

U.S. PATENT DOCUMENTS

| | | | |
|---|---|---|---|
| 605,230 | 6/1898 | Lightenhome | 15/191.1 X |
| 2,258,361 | 10/1941 | Hewes | 15/192 |
| 2,397,471 | 4/1946 | Cox | 300/21 |
| 2,562,716 | 7/1951 | Hervey | 300/21 |
| 2,643,157 | 6/1953 | Hardman et al. | 300/21 |
| 2,653,056 | 9/1953 | Montero et al. | 300/21 |
| 2,664,316 | 12/1953 | Winslow, Jr. et al. | 300/21 |
| 4,519,110 | 5/1985 | Rubin | 15/159.1 |
| 4,697,851 | 10/1987 | Takahashi | 300/21 X |
| 5,483,723 | 1/1996 | Wenzer | 15/204 X |

FOREIGN PATENT DOCUMENTS

| | | |
|---|---|---|
| 329939 | 8/1989 | European Pat. Off. . |
| 519677 | 12/1992 | European Pat. Off. . |
| 90/00359 | 1/1990 | WIPO . |

*Primary Examiner*—Mark Spisich

*Attorney, Agent, or Firm*—Antonelli, Terry, Stout & Kraus, LLP

[57] ABSTRACT

A method of permanently mounting bristles on a handle to form a brush, and a brush having bristles which extend preselected, irregular distances from the brush handle. First ends of bristles of substantially equal length are contacted against an insert element or a receiving body having a contour corresponding with the preselected, irregular distances. The insert element is heated to soften the bristle first ends or the receiving body, and then the insert element is cooled to harden the softened one of the bristle first ends and the receiving body, fastening the bristle first ends to the insert element. The insert element is fastened in a receptacle in the brush handle. As a result, the bristles extend from the brush handle with the corresponding contour. The several steps may be performed in various sequences.

17 Claims, 4 Drawing Sheets

METHOD FOR PRODUCING BRUSHES WITH FLEXIBLE BRISTLES AND BRUSHES WITH STIFF BRISTLES

FIELD OF THE INVENTION

The present invention relates to a method for permanently mounting bristles, hairs, monofilaments, wires, and the like and/or tufts thereof in or on a handle. The present invention further relates to an application of the method to produce a brush with soft bristles or a brush with flexible bristles, including a brush with a specific shape. Additionally, the invention relates to a brush with flexible bristles or a brush with stiff bristles, the brush including a handle as well as hairs, bristles, monofilaments, or wires providing flexible bristles or stiff bristles held in or on the handle.

BACKGROUND OF THE INVENTION

The manufacture of brushes with stiff bristles, brushes with flexible bristles, toothbrushes, and the like is performed in a wide variety of ways. Thus, for example, to manufacture paint brushes or cleaning brushes, the tufts of bristles or hairs are retained by phenol or epoxy resin materials in a receiving box or a handle.

In the case of smaller brushes, such as toothbrushes or precision cleaning brushes, as a rule monofilaments are held in a receptacle either by means of hot-melt materials or by so-called anchors. It is also known to introduce individual monofilaments or tufts thereof into receptacles in the shape of holes, and to weld shut the hole opening.

The known methods are either partially objectionable from the physiological standpoint or are expensive, or they do not allow very small brushes to be manufactured. Thus it has been found especially in the manufacture of very small brushes for electrical cleaning devices, or of very fine cleaning brushes, for example for precision mechanics, that with very small wall thicknesses for the brush bodies, the known fastening methods are not suitable for retaining brush hairs, bristles, or monofilaments, etc. In addition, it is not possible with the known methods to shape the brush or to form the brush surface.

Three U.S. Pat. Nos., 2,653,056, 2,664,316, and 2,397,471 describe the manufacture of brushes with stiff bristles, particularly toothbrushes, with the bristle tufts being fastened in the handle by metal inserts and inductive heating.

EP-0,519,677 describes the manufacture of brushes with stiff bristles using ultrasonic welding.

WO90/00359 describes a method of manufacturing small brushes with stiff bristles, with bristle structures disposed in practically any desired manner. It proposes that either a through opening be provided on a holder, and the bristle tuft be inserted into this opening, in order to pot it, glue it, or weld it from the other side of the holder, or alternatively a blind hole be made in the holder in order to use the remaining covering wall of the blind hole as a welding material after insertion of the tuft.

Finally, EP-A-0,329,939 describes a method and a device for making devices for applying fluid media by means of bristles.

The methods described in the prior art relate firstly to the manufacture of brushes with stiff bristles, with no adhesives or hot melt materials having to be used to secure the bristles or monofilaments that form the bristles, or relate to methods and devices for producing bristle structures or bristle tufts, either by applied heat or by adhesives.

None of the publications known from the prior art is suitable for the manufacture of very delicate and/or very small brushes with stiff bristles or flexible bristles, in whose manufacture the shaping of the tufts is important, or in which special bristle structures are to be produced.

SUMMARY OF THE INVENTION

Hence, one goal of the present invention is to propose a method that does not suffer from the above disadvantages and which is especially suited for permitting the manufacture of very fine and/or very small brushes, and to facilitate the shaping process in the manufacture of brushes with flexible bristles and brushes with stiff bristles.

In accordance with the present invention, in order to permanently mount bristles, hairs, or monofilaments or tufts thereof in or on a handle or in or on a receptacle, the bristles, hairs, monofilaments, or wires are placed in or on the receptacle or the handle and are connected to the receptacle or handle by welding. The welding is performed by means of wave or field lines applied and/or directed at the receptacle or handle.

These waves or field lines applied or directed to the receptacle stimulate an insert element introduced onto or into the receptacle or the handle, and heat the latter to produce the welded connection.

According to one embodiment of the method of the invention, initially at least one insert element is placed on or in the receptacle, then the hairs, bristles, monofilaments, or wires are supplied, and then a high-frequency field, which can be an electrical, electromagnetic, and/or a magnetic field, is produced in order to excite or heat the insert element so that the hairs, bristles, monofilaments, or wires in contact with the element, and/or the receptacle, are at least partially melted in order to produce the melted connection.

According to another variation on the method according to the invention, initially an insert element is introduced into or onto the retaining element or the receptacle in order to be welded with it as it is excited by field or wave lines or in order to be joined mechanically or by adhesives. Then the hairs, bristles, monofilaments, or wires are introduced in the area of the insert element in or on the handle or receptacle, whereupon, by means of field or wave lines, the insert element is excited in order to trigger possible additional welding under temperature conditions that may be different from those of the first welding.

This two-stage method is preferably used when the hairs, bristles, monofilaments, or wires exhibit a very different melting behavior from the receiving part or the handle. In the case of highly different melting temperatures, there is a danger in the single-stage method that either the hairs, bristles, monofilaments, or wires or the handle or the receptacle may be damaged by excessive heating.

Another advantage of this two-stage method consists in the fact that initially the handle or the receptacle can be provided with an insert element, and then a supply of hairs, bristles, monofilaments, or wires can be added. The excitation of the insert element then takes place in this supply, whereupon only those hairs, bristles, monofilaments, or wires from the supply are welded to the insert element that are directly in contact with it. In this way the manufacture of a brush with stiff bristles or a brush with flexible bristles can be highly simplified.

Another two-stage method according to the invention is similar, and it proposes that initially the hairs, bristles, monofilaments, or wires be placed in an insert element which is excited and heated by field or wave lines in order to at least soften or begin melting the added bristles, hairs, monofilaments, or wires to make a welded connection with the insert element. Then this insert element with the hairs, bristles, monofilaments, or wires welded to it is placed on or in a handle or a receptacle and connected with the latter mechanically by gluing or by welding once more.

The methods defined according to the invention are especially suitable for producing a specific shape of a brush with stiff bristles or with flexible bristles, in which the insert element is adapted specially to the shape of the brush to be produced. The insert element, depending on the requirements, can be made convex, wavy, zigzag-shaped, conical, etc. whereby the ends of the hairs, bristles, or monofilaments projecting out of the receptacle form a contour that matches the insert element.

The insert element however can also have gaps in the form of holes or slots, which means that the brush does not have any hairs, bristles, monofilaments, or wires at these gaps.

By using the above-mentioned insert elements, comprising gaps in the form of holes or slots, it is also possible to make brushes that have areas in which the hairs, bristles, monofilaments, or wires have a reduced density. This can also be achieved by using a plurality of insert elements spaced apart from one another. In the spaces between the insert elements, zones can be created that have no hairs, bristles, monofilaments, or wires, or zones with reduced density. The advantage of creating such areas or zones of reduced density consists in the fact that the flexibility of a brush with flexible bristles or a brush with stiff bristles can be considerably increased as a result.

Basically, the methods proposed according to the invention are generally suitable for manufacturing all kinds of brushes with flexible bristles or stiff bristles, for example paintbrushes, cleaning brushes, toothbrushes, precision cleaning brushes in mechanics, etc.

The methods according to the invention are especially suitable for making toothbrushes, both ordinary toothbrushes and those designed for use with an electrical tooth cleaning device.

The brushes with flexible bristles or brushes with stiff bristles manufactured according to the invention thus comprise a handle or receiving part or a receptacle, as well as hairs, bristles, monofilaments, or wires which form flexible bristles or stiff bristles that are held in the handle or receiving part, whereby at least one insert element is provided which is located in or on the receiving part or handle, and which is located adjacent to the hairs, bristles, monofilaments, or wires held in the handle or receiving part, and with the hairs, bristles, monofilaments, or wires being held in or on the handle or receiving part by a welded connection.

It makes no difference in this respect whether the hairs, bristles, monofilaments, or wires are of animal or plant origin or whether they are monofilaments made of polymer materials, like those manufactured for example from a synthetic polymer.

BRIEF DESCRIPTION OF THE DRAWINGS

The invention will now be described in greater detail with reference to the attached figures. In the drawings.

DETAILED DESCRIPTION

Figure 1A:
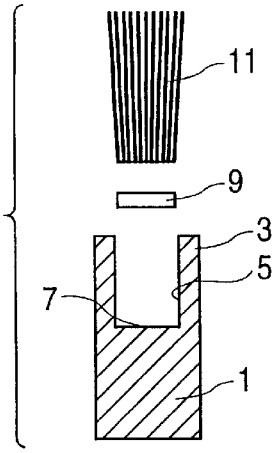
FIGS. 1*a* to 1*c* show schematically the basic idea of the present invention for manufacturing a brush with flexible bristles or a brush with stiff bristles.
Figure 1B:
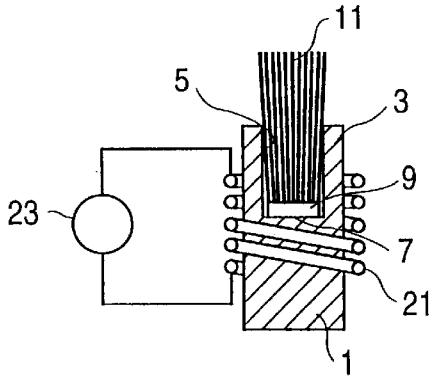
Figure 1C:
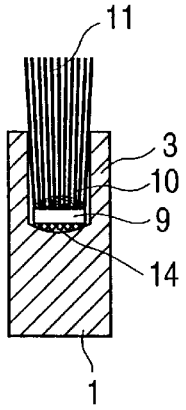

In FIGS. 1*a* to 1*c*, a method according to the invention is shown schematically to indicate how the hairs, bristles, monofilaments, and the like, or tufts thereof, of brushes with stiff bristles or with flexible bristles are permanently mounted in a receptacle.

A body 1 of a brush with stiff or flexible bristles comprises a receptacle 5 that is delimited laterally by walls 3 and has a bottom 7. An insert element 9 is provided for insertion into this receptacle 5, the element preferably being made in the form of a disk, foil, lattice, wire, ring, or plate, or as a molded body. Hairs, bristles, monofilaments, or wires 11 are also provided for insertion and permanent mounting.

In FIG. 1*b*, both insert element 9 and the hairs or bristles or monofilaments 11 are shown inserted into receptacle 5. The body 1 of the brush is inserted into a wire coil 21, the coil being located in the vicinity of insert element 9. It is important to note in this regard that coil 21 should be located as close as possible to the external contour of body 1 of the brush with flexible bristles or brush with stiff bristles. By applying a current, such as an alternating current for example, through wire coil 21, a magnetic field is generated that changes its direction synchronously with the frequency of the alternating current.

If insert element 9 is an electrically conducting material, for example an electrically conducting metal such as iron or copper, an alternating voltage will be induced in the insert element, or eddy currents will be produced in the insert element, so that insert element 9 is heated. As a result of the strong heating of insert element 9, firstly the ends of the hairs, bristles, monofilaments, or wires inserted into receptacle 5 will be at least softened or slightly melted, as will bottom 7 of the receptacle. This produces a welded connection, and the hairs, bristles, monofilaments, or wires are thus held firmly in receptacle 5.

In FIG. 1*c*, the brush with stiff or flexible bristles that is eventually obtained according to the invention is shown, with the idea according to the invention being indicated schematically by the fact that, above insert element 9, a welded layer 10 is formed. Of course a welded connection 14 can be produced between the insert element and brush body 1 as well.

In the method using inductive heating that is described with reference to FIGS. 1*a* to 1*c,* this is of course only an example that can be supplemented by additional suitable methods.

Thus it is possible for example to insert an insert element 9 that does not conduct, or conducts only slightly, and to heat it by using so-called dielectric or capacitive heating. Then insert element 9 together with two plate electrodes forms the lossy dielectric of a capacitor powered with high frequency. The dielectric losses cause insert element 9 to be heated uniformly.

Another possibility is to use a material that has mostly polar compounds as insert element 9. In this case the heating can be produced by microwaves. However the use of ultrasound or other suitable high-frequency waves or electrical, electromagnetic, or magnetic fields is possible, by means of which suitable materials can be excited in order to heat them in this manner. Although inductive heating is described with reference to FIGS. 1*a* to 1*c,* the present invention is not limited in any way to this type of heating.

If neither the receiving part nor the brush hairs, bristles, monofilaments, or wires consist of a material that can be softened or melted, or if they have a melting point that is too high, it is also possible to introduce a so-called intermediate support into the receptacle that rests directly above the insert element for example. This intermediate support then consists of a material that can be melted slightly by heating the insert element in order in this way to produce the welded connection of the hairs, bristles, monofilaments, or wires inserted into the receptacle, with the receptacle itself.

Another possibility consists in making the method according to the invention in two stages in which initially insert element 9 and the hairs, bristles, monofilaments, or wires 11 are welded outside receptacle 5. Then insert element 9 together with the hairs, bristles, monofilaments, or wires welded to it is introduced into receptacle 5 in order again to be secured in the latter by welding, or by means of conventional adhesives, or by using mechanical retainers. Thus it is possible for example to provide insert element 9 with lateral clamping elements which secure insert element 9 in the receptacle.

Yet another possibility consists in performing the method in two stages, but in which insert element 9 is initially connected with receptacle 5. This connection again can be made by welding, gluing, or mechanically. In a second step, the hairs, bristles, monofilaments, or wires are then introduced in order to be welded into the receptacle by using the method described in connection with FIGS. 1*a* to 1*c*. By means of this latter two-stage method it is then possible to take the receptacle together with the insert element to a supply of hairs, bristles, monofilaments, or wires, to apply the supply, and then to fasten the necessary number by means of the welding method according to the invention. Then the receptacle with the insert element can be taken away from the supply once more and the required hairs, bristles, monofilaments, or wires are accordingly removed from the supply.

In regard to the method to be used for heating the insert element, it should also be noted that it basically involves methods that are known from the prior art. It is in the final analysis a question of optimization as to which method and which process conditions are selected. In the case of inductive heating, it should be added that the heating of the insert element is dependent upon firstly the distance of the wire coil from the insert element, the number of turns, the wire material selected, the applied field strength or current density, and the time during which the insert element is heated. Heating of the insert element however can be also controlled by the selected form of insert element, since the weight, size, and selected material play an important role for example. Thus for example an annular insert element can be heated readily, while a ring that is interrupted at one point is practically impossible to heat.

However these factors also make it possible to control the heating of the insert element or to establish a temperature range to which the insert element is to be heated. In addition, reference should be made to the prior art from which the above-mentioned methods and procedures are best known.

Figure 2A:
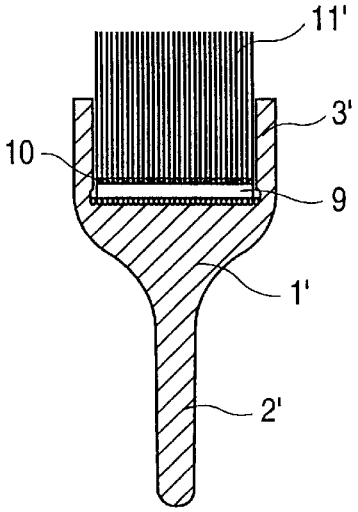
FIGS. 2*a* and 2*b* show two examples of a brush with flexible bristles and of a toothbrush manufactured according to the invention.

FIG. 2*a* shows a brush 1' with flexible bristles 11' which has been produced according to the invention, comprising a handle 2' as well as a thin-walled receptacle 3' into which the hairs 11' are inserted. The melted layer 10 by means of which the hairs 11' are held in the brush can be seen above insert element 9.

Figure 2B:
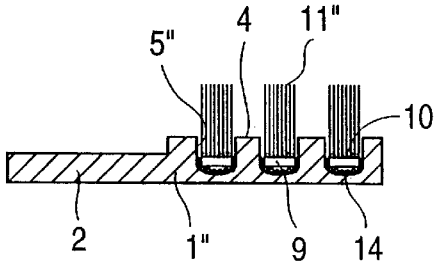

FIG. 2*b* shows a toothbrush 1" manufactured according to the invention that has a specially shaped handle 2", suitable for example for use of this toothbrush on an electrical tooth cleaning device. Once again the individual bristles or monofilaments 11" are held by a welded connection 10, 14 on insert element 9. These monofilaments for example can be polyamides or another polymer material that is usually used for manufacturing toothbrushes.

As described above, the method according to the invention is suitable for giving brushes with stiff bristles and brushes with flexible bristles a specific contour.

As is clearly evident from FIG. 2*b,* a plurality of receptacles 5" is formed in toothbrush 1" into each of which an insert element 9 is fitted. Thus so-called gaps 4 are produced between the various receptacles 5" and have no insert element. In this way it is basically possible to make brushes that have a plurality of bristle tufts with gaps between them. It is also possible to make a toothbrush with gaps 4 so that the flexibility of the individual bristle tufts 11" is increased considerably, which is especially desirable in toothbrushes.

Figure 3:
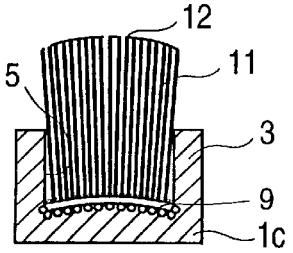
FIG. 3 shows one possible application of the method according to the invention for making a brush with a specific contour of stiff bristles or flexible bristles according to the invention.

FIG. 3 shows in a cross section how a brush 1*c* with stiff bristles or with flexible bristles can be made convex or projecting. Insert element 9 used in FIG. 3 is likewise made convex or projecting, so that when hairs, bristles or monofilaments of the same length are used an external contour 12 that is convex or projecting can be produced. The manufacture of such a brush with flexible bristles or a brush with stiff bristles of this kind is performed by analogy with the method described for example with reference to FIGS. 1*a* to 1*c*.

Figure 4:
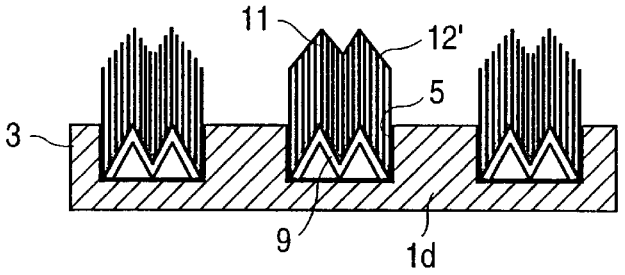
FIG. 4 shows another example of one possible embodiment of a contour of a brush with flexible bristles or stiff bristles according to the invention.

Similarly in FIG. 4 an insert element 9 of a different design is employed, having a zigzag shape, for example, whereby brush 1*d* in FIG. 4 has three receptacles 5. Again the outer contour 12' of the individual elements of the brush with stiff or flexible bristles is made zigzag shaped.

The great advantage of providing this contour by means of an insert element consists in the fact that after the brush with stiff or flexible bristles is produced, the individual hairs, bristles, or monofilaments do not have to be cut in order to produce the desired external contour 12. Especially in the case of monofilaments it has been found that during cutting, the ends that project out of the receptacle are indented or frayed, which is undesirable especially in the case of toothbrushes, since the gums can be injured by damaged bristles. In this case it is necessary after cutting to use a special grinding or melting method to round off the ends of the hairs, bristles, monofilaments, or wires projecting out of the receptacle, said method being relatively costly and cumbersome. According to the invention, there is no need for this additional step.

With the manufacturing method in use today for making brushes with flexible bristles and brushes with stiff bristles, in producing brushes with flexible and stiff bristles with special shapes, it is necessary as a rule to cut and grind the hairs, bristles, monofilaments, or wires before making the brush, which is cumbersome. Brush shapes, like those shown in FIG. 4, cannot be made with conventional methods.

Figure 5:
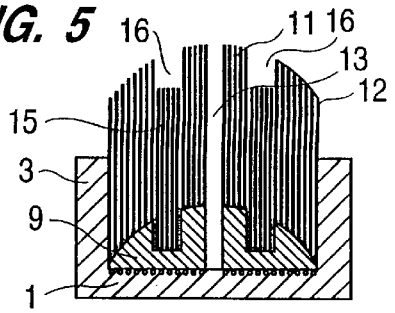
FIGS. 5 and 6 show additional examples of the design of a contour for a brush with flexible bristles or stiff bristles according to the invention, including so-called gaps.
Figure 6:
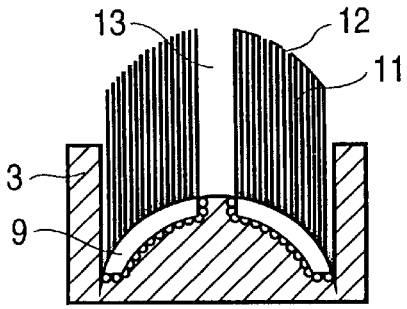

In FIGS. 5 and 6, an insert element 9 is employed that has a hole or gap 13 in the middle. Insert element 9 in FIG. 5 also has an indentation or groove 15. Accordingly, gap 13 is located centrally in contour 12 of the brush manufactured according to the invention, since no welding of the inserted hairs, bristles, or monofilaments can take place in the middle of hole 13. After the brush with flexible or stiff bristles according to the invention has been manufactured, the hairs, bristles, or monofilaments that are inserted into gap 13 automatically fall out again. Moreover, external contour 12 has a matching groove or indentation 16 in the vicinity of indentation or groove 15.

Similarly in brushes with stiff bristles and brushes with flexible bristles, areas can also be produced with a lower hair, bristle or monofilament density. In this way, as already mentioned in connection with FIG. 2*b,* the flexibility of a brush with stiff bristles or a brush with flexible bristles can be increased.

FIGS. 5 and 6 however again show the advantage of the method according to the invention as mentioned with reference to FIG. 4 when it comes to creating contours or brush shapes without the necessity of cutting and grinding hairs, bristles, monofilaments, wires, or the like before or after the brush with flexible or stiff bristles is manufactured.

Figure 7A:
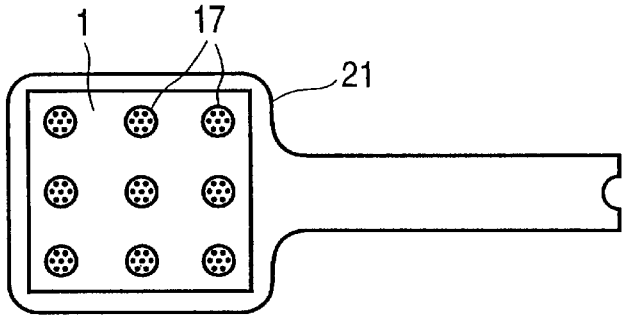
FIGS. 7*a* and 7*b* show one possible embodiment of a brush with flexible bristles or stiff bristles according to the invention, as well as the manufacturing process according to the invention, shown schematically.
Figure 7B:
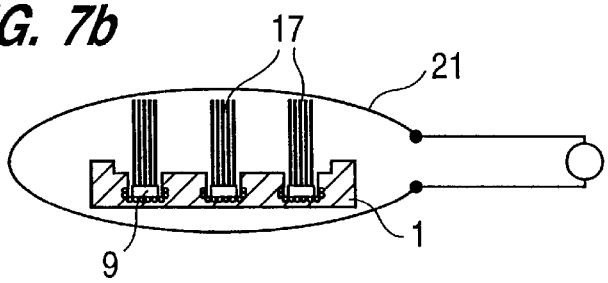

FIGS. 7*a* and 7*b* show a brush with stiff bristles or a brush with flexible bristles which are provided in individual tufts 17. If as shown in FIG. 7*a* a wire coil 21 is placed around body 1 of the brush with flexible or stiff bristles or the outside wall 3, the peripheral tufts 17 of hair or monofilament of the brush with flexible bristles would be melted to a greater degree at the inserted ends, since the peripheral insert elements would also be heated to a greater degree. However, there would be a danger in the middle tufts that no real melting would take place so that the hairs, bristles, or monofilaments of such tufts would fall out again when manufacture was complete.

For this reason it is advantageous as shown in FIG. 7*b* to rotate the coil 21 through approximately 90°, compared with the diagram in FIG. 7*a* and to insert brush 1 with stiff bristles in the horizontal direction into coil 21. This in turn ensures that all the insert elements 9 are arranged equally spaced relative to coil 21. As a result the insert elements 9 will also be heated uniformly.

Figure 8:
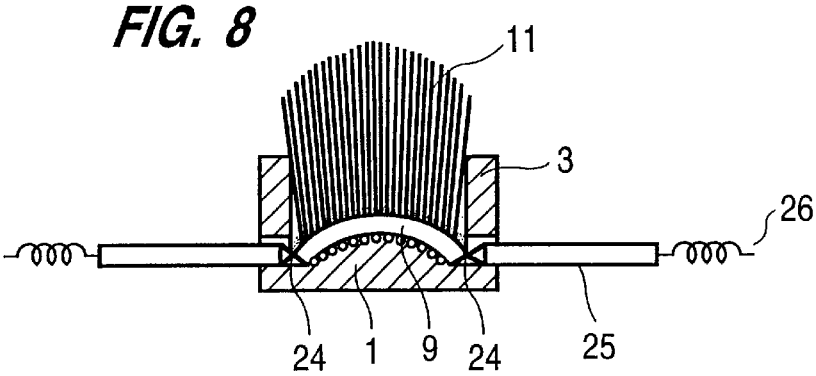
FIG. 8 shows another possible method for manufacturing a brush with flexible bristles or stiff bristles according to the invention.

In FIG. 8 another possibility is shown of how an insert element for the welding of the ends of the hairs, bristles, or monofilaments inserted in the receptacle of the brush with flexible or stiff bristles can be achieved. In FIG. 8, hole-shaped contact points 24 to which electrodes or terminals 25 can be connected are provided in the lateral receptacle walls 3. If an electrical current is applied to the electrodes or terminals 25, insert element 9 acts as a form of resistance element and is heated as a result. Welding of the hairs, bristles or monofilaments 11 takes place once more in known fashion and as described with reference to FIGS. 1*a* to 1*c*.

Figure 9:
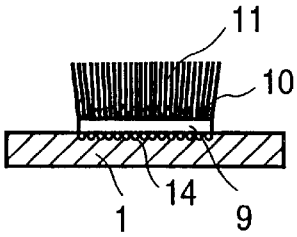
FIGS. 9 and 10 show other examples of brushes with flexible bristles or stiff bristles manufactured according to the invention.
Figure 10:
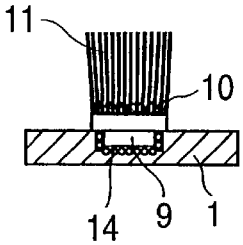

FIGS. 9 and 10 show two additional examples of a brush with flexible bristles or a brush with stiff bristles manufactured according to the invention, whereby no actual receptacle 5 is provided on handle 1, but where insert element 9 is mounted directly on a flat surface on the handle or the brush or hair body. Thus, no walls 3 are provided laterally with respect to insert element 9, as in the brushes shown in FIGS. 1 to 8. In FIG. 9 the insert element is made plate-shaped in a single stage, while insert element 9 in FIG. 10 is made in two layers, with the lower part being provided in order to be fitted into the handle or body 1 while the upper part is provided to hold hairs, bristles, monofilaments, or wires.

Again it is possible to join insert element 9 with the handle or body 1 by gluing, mechanically, or by welding, while the hairs, bristles, monofilaments, or wires of the brush with flexible bristles or brush with stiff bristles are joined with insert element 9 by welding. Once again welding layers 10 and 14, which are shown schematically, can be produced by means of the above-mentioned intermediate support, if welding of the hairs, bristles, monofilaments, or wires is not possible. Metal wires are mentioned as an example of this, which as a rule cannot be melted or softened by the method according to the invention. In this case it is definitely advantageous to use an intermediate support, for example consisting of a hot-melt material that can be readily melted or softened.

Figure 11:
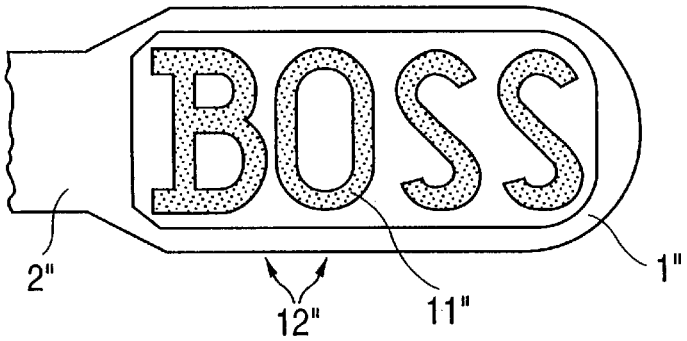
FIGS. 11 and 12 show examples of specific forms of a toothbrush, for example for advertising purposes.
Figure 12:
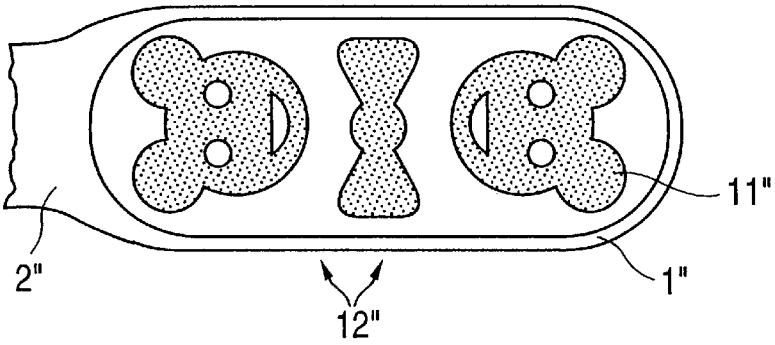
Figure 13A:
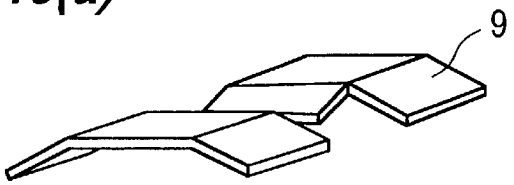
FIGS. 13*a* to 13*d* show possible heating element shapes for specific shaping of a brush with stiff bristles.
Figure 13B:
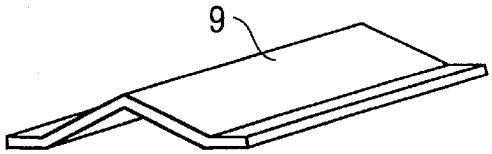
Figure 13C:
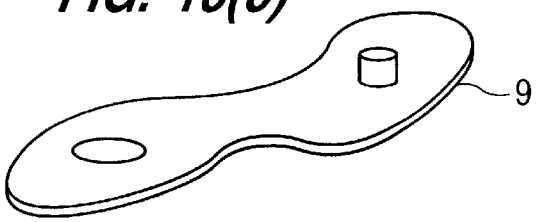
Figure 13D:
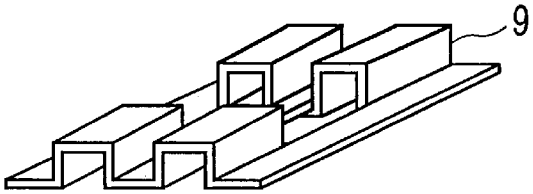

In FIGS. 11 and 12 in a schematic top view, a head 1" of a toothbrush 2" is shown, comprising bristle tufts 11" that have a specific concrete shape 12". In the case of FIG. 11, it is a company name so that the toothbrush shown can be used for example for advertising purposes. In the case of FIG. 12, bristle tuft 11" has the shape of comic figures so that the toothbrush 1" shown in FIG. 12 is suitable for children for example.

FIGS. 13*a* to 13*d* show various heating elements 9 that can be used to produce special shapes.

Finally, with reference to FIGS. 14*a* to 14*e,* the manufacture of a toothbrush or a toothbrush head, shown schematically, will be described in order for example to give the brush head a shape similar to the brush head shown in FIG. 11.

Figures 14A, 14B, 14C, 14D, 14E:
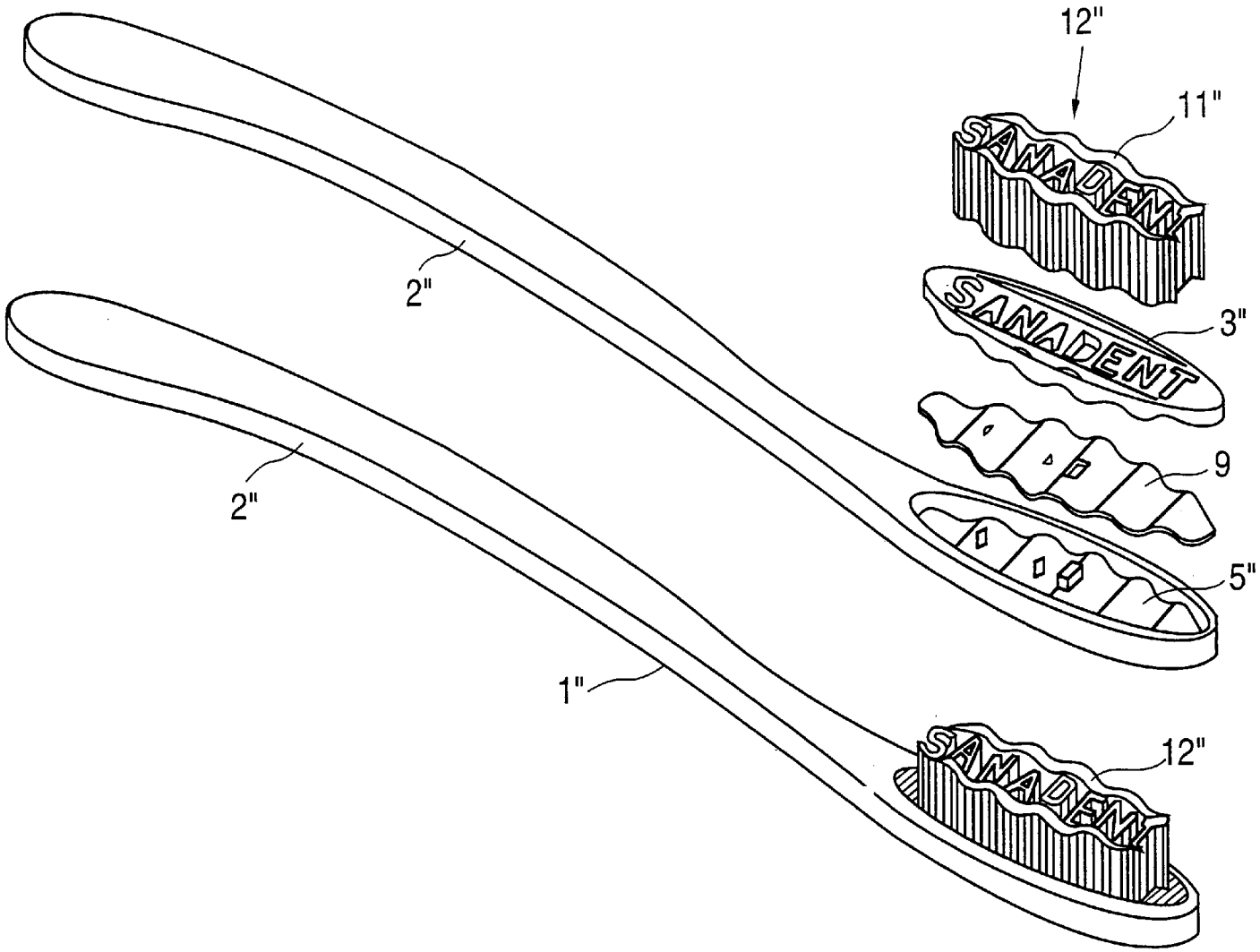
FIGS. 14*a* to 14*e* show schematically the manufacture of a toothbrush with a specific shape for the brush head.

The process begins with a basic toothbrush body 21", having at one end a head receptacle 5", as shown in FIG. 14*a*. The heating element 9 shown in FIG. 14*b* is inserted into receptacle 5", with the bottom of receptacle 5" matching the corrugated shape of heating element 9. A receiving body 3", shown in FIG. 14*c,* is placed on heating element 9. This receiving body 3" has gaps or openings for insertion of toothbrush bristles 11" shown in FIG. 14*d*. Originally the toothbrush bristles 11" are of the same length, whereupon the insertion of bristles 11" through receiving body 3" into receptacle 5" produces shape 12" as shown in FIG. 14*d*. Finally the heating of heating element 9 according to the invention produces the toothbrush head or toothbrush 1" as shown in FIG. 14*e*.

In the manufacturing method and designs of brushes with stiff bristles or brushes with flexible bristles according to the invention as shown in FIGS. 1 to 14, only examples are involved and of course they can be supplemented or modified or changed in some way. Thus of course it makes no difference whether the hairs, bristles, monofilaments, and the like are of animal or plant origin or are synthetic polymers or materials. Examples include sisal, ramie, hog bristles, hairs of whatever kind, monofilaments made of metal, glass, polyamide, polyethylene, polyester, polypropylene, PVC, polystyrene, etc., or wires, threads, cables, strings, made of any synthetic or natural materials.

The inductive heating of the insert element is likewise only one possible example, and other examples such as dielectric heating, heating using microwaves, ultrasound, etc. are possible variations for working the method according to the invention.

In the designs shown in FIGS. 3 to 6 as well as 11, 12, and 14, once again only examples are involved and any shapes or contours can be produced by appropriately shaping the insert element.

It is important that the fastening of the hairs, bristles, monofilaments, and the like in or on the receptacle or the handle of the brush be performed by welding, with the welding being performed by applying wave or field lines onto or into the receptacle or handle.

I claim:

1. A method of attaching a plurality of bristles of substantially equal length in a receptacle on a brush body, utilizing an insert element, so as to provide a brush with bristles extending from the brush body by preselected, irregular distances, said method comprising the steps of:

(a) contacting the insert element with first ends of the plurality of bristles, the insert element having a contour corresponding with the preselected, irregular distances, so as to cause second ends of the bristles to have the corresponding contour;

(b) subjecting the insert element to energy to heat the insert element so as to soften the bristle first ends;

(c) cooling the insert element to harden the bristle first ends so as to attach the bristle first ends to the insert element;

(d) inserting the insert element into the receptacle; and (e) attaching the insert element in the receptacle.

2. A method as claims in claim 1, wherein the steps of the method are performed in the sequence step (d), step (e), step (a), step (b) and step (c).

3. A method as claimed in claim 1 wherein the steps of the method are performed in the sequence step (d), step (a), step (b), and step (c), with step (e) being performing during performance of steps (b) and (c).

4. A method as claimed in claim 1 wherein the steps of the method are performed in the sequence of step (a), step (b), step (c), step (d) and step (e).

5. A method as claimed in claim 1, wherein step (b) comprises heating the insert element by inductive heating.

6. A method as claimed in claim 1, wherein step (b) comprises heating the insert element by dielectric heating.

7. A method as claimed in claim 1, wherein step (b) comprises heating the insert element by resistance heating.

8. A method as claimed in claim 1, wherein step (b) comprises subjecting the insert element to microwave energy to cause heating of the insert element.

9. A method as claimed in claim 1, wherein step (b) comprises subjecting the insert element to ultrasound energy to cause heating of the insert element.

10. A method as claimed in claim 1 wherein step (e) comprises heating the insert element to soften a surface of the receptacle, and cooling the insert element to harden the softened surface so as to fasten the insert element in the receptacle.

11. A method as claimed in claim 1 wherein step (e) comprises gluing the insert element in the receptacle.

12. A method as claimed in claim 1 wherein step (e) comprises clamping the insert element within the receptacle.

13. A method of attaching a plurality of bristles of substantially equal length in a receptacle on a brush body, utilizing an insert element and a receiving body, so as to provide a brush with bristles extending from the brush body by preselected, irregular distances, said method comprising the steps of:

(a) contacting the receiving body with first ends of the plurality of bristles, the receiving body having a contour corresponding with the preselected distances, so as to cause second ends of the bristles to have the corresponding contour;

(b) contacting the receiving body with the insert element;

(c) subjecting the insert element to energy to heat the insert element so as to soften the receiving body;

(d) cooling the insert element to harden the receiving body so as to attach the receiving body to the bristle first ends and the insert element;

(e) inserting the insert element into the receptacle; and (f) attaching the insert element in the receptacle.

14. A method as claimed in claim 13, wherein the steps of the method are performed in the sequence step (a), step (b), step (e), step (c), and step (d), with step (f) performed during performance of steps (c) and (d).

15. A method of attaching a plurality of bristles of substantially equal length on a brush body utilizing an insert element so as to provide a brush with bristles extending from the brush body by preselected, irregular distances, said method comprising the steps of:

(a) forming in the brush body at least one receptacle having a surface with a contour corresponding with the preselected, irregular distances;

(b) inserting the insert element into the receptacle, the insert element having substantially the corresponding contour;

(c) contacting the insert element with first ends of the plurality of bristles to cause second ends of the bristles to have the corresponding contour;

(d) subjecting the insert element to energy to heat the insert element so as to soften the bristle first ends;

(e) cooling the insert element to harden the bristle first ends so as to attach the bristle first ends to the insert element; and (f) attaching the insert element in the receptacle.

16. A method as claimed in claim 15, wherein the steps of the method are performed in the sequence step (a), step (b), step (c), step (d) and step (e), with step (f) being performing during performance of steps (d) and (e).

17. A method as claimed in claim 15, wherein step (f) comprises heating the insert element to soften a surface of the receptacle, and cooling the insert element to harden the softened surface, fastening the insert element in the receptacle.

* * * * *